US008739889B2

(12) United States Patent
Gerrard et al.

(10) Patent No.: US 8,739,889 B2
(45) Date of Patent: Jun. 3, 2014

(54) ANNULAR PRESSURE REGULATING DIAPHRAGM AND METHODS OF USING SAME

(75) Inventors: David P. Gerrard, Magnolia, TX (US); Edward T. Wood, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 416 days.

(21) Appl. No.: 13/195,314

(22) Filed: Aug. 1, 2011

(65) Prior Publication Data

US 2013/0032354 A1 Feb. 7, 2013

(51) Int. Cl.
*E21B 43/00* (2006.01)

(52) U.S. Cl.
USPC ..... 166/380; 166/205

(58) Field of Classification Search
USPC ..... 166/373, 207, 321, 205
See application file for complete search history.

(56) References Cited

U.S. PATENT DOCUMENTS

| | | | |
|---|---|---|---|
| 3,527,297 | A | 9/1970 | Todd |
| 3,633,671 | A | 1/1972 | Nelson |
| 4,260,017 | A | 4/1981 | Nelson et al. |
| 4,729,430 | A | 3/1988 | White et al. |
| 4,936,383 | A | 6/1990 | Towner et al. |
| 5,020,600 | A | 6/1991 | Coronado |
| 5,024,273 | A | 6/1991 | Coone et al. |
| 5,048,611 | A | 9/1991 | Cochran |
| 5,174,379 | A | 12/1992 | Whiteley et al. |
| 5,860,452 | A | 1/1999 | Ellis |
| 6,092,611 | A | 7/2000 | Saxman |
| 6,109,356 | A | 8/2000 | Echols et al. |
| 6,155,342 | A | 12/2000 | Oneal |
| 6,186,236 | B1 | 2/2001 | Cox |
| 6,216,785 | B1 | 4/2001 | Achee, Jr. et al. |
| 6,253,861 | B1 | 7/2001 | Carmichael et al. |
| 6,431,291 | B1 | 8/2002 | Moore et al. |
| 6,571,875 | B2 | 6/2003 | Bissonnette et al. |
| 6,973,978 | B2 | 12/2005 | Cravatte |
| 7,011,153 | B2 | 3/2006 | Erkol |
| 7,066,264 | B2 | 6/2006 | Bissonnette et al. |

(Continued)

FOREIGN PATENT DOCUMENTS

| | | | |
|---|---|---|---|
| EP | 0207785 | A2 | 1/1987 |
| WO | WO/0188328 | A1 | 11/2001 |

OTHER PUBLICATIONS

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

(Continued)

*Primary Examiner* — Brad Harcourt
(74) *Attorney, Agent, or Firm* — Parsons Behle & Latimer

(57) ABSTRACT

Downhole tools comprise a housing chamber with an expandable member disposed therein. An interior of the expandable member is in fluid communication with an outside environment so that hydrostatic pressure can act on an inner wall surface of the expandable member. The outer wall surface of the expandable member partially defines a sealed chamber within the housing chamber such that expansion of the expandable member due to an increase in hydrostatic pressure causes the volume within the sealed chamber to decrease, thereby energizing the sealed chamber. Thus, an increase in hydrostatic pressure within an outside environment is compensated. Further, when the hydrostatic pressure within the outside environment decreases, the energized sealed chamber causes contraction of the expandable member, thereby compensating for the decrease in hydrostatic pressure.

20 Claims, 2 Drawing Sheets

(56) References Cited

U.S. PATENT DOCUMENTS

| | | | | |
|---|---|---|---|---|
| 7,108,015 | B2 | 9/2006 | Lombari et al. | |
| 7,147,052 | B2 | 12/2006 | Erkol | |
| 7,353,845 | B2 | 4/2008 | Underwood et al. | |
| 7,500,526 | B2 | 3/2009 | Telfer | |
| 7,503,384 | B2 | 3/2009 | Coronado | |
| 7,628,213 | B2 | 12/2009 | Telfer | |
| 7,661,478 | B2 | 2/2010 | Palmer et al. | |
| 7,665,545 | B2 | 2/2010 | Telfer | |
| 7,762,324 | B2 | 7/2010 | Clem | |
| 7,861,744 | B2 | 1/2011 | Fly et al. | |
| 8,066,074 | B2 | 11/2011 | Maskos et al. | |
| 8,297,358 | B2 | 10/2012 | Korkmaz et al. | |
| 8,347,969 | B2 * | 1/2013 | Orr et al. | 166/373 |
| 2003/0141059 | A1 | 7/2003 | Mauldin et al. | |
| 2004/0035591 | A1 | 2/2004 | Echols | |
| 2004/0094304 | A1 | 5/2004 | Turner et al. | |
| 2004/0159447 | A1 | 8/2004 | Bissonnette et al. | |
| 2005/0279501 | A1 | 12/2005 | Surjaatmadja et al. | |
| 2006/0191685 | A1 | 8/2006 | Coronado | |
| 2007/0012458 | A1 | 1/2007 | Jackson | |
| 2007/0240883 | A1 | 10/2007 | Telfer | |
| 2008/0093080 | A1 | 4/2008 | Palmer et al. | |
| 2009/0056952 | A1 | 3/2009 | Churchhill | |
| 2009/0139718 | A1 | 6/2009 | Clem | |
| 2009/0139720 | A1 | 6/2009 | Frazier | |
| 2010/0032162 | A1 | 2/2010 | Olstad et al. | |
| 2010/0163249 | A1 * | 7/2010 | Du et al. | 166/381 |
| 2010/0181080 | A1 | 7/2010 | Levy | |
| 2010/0270030 | A1 | 10/2010 | Ashy et al. | |
| 2010/0319927 | A1 | 12/2010 | Yokley et al. | |
| 2010/0326737 | A1 | 12/2010 | Peddle et al. | |
| 2012/0090852 | A1 | 4/2012 | Orr et al. | |
| 2012/0111574 | A1 | 5/2012 | Desranleau et al. | |
| 2012/0255741 | A1 | 10/2012 | Stewart | |

OTHER PUBLICATIONS

Henry Restarick, Horizontal Completion Options in Reservoirs With Sand Problems, Mar. 11, 1995, pp. 545-560, SPE 29831, Society of Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

Nicholas J. Clem, et al., Utilizing Computational Fluid Dynamics (CFD) Analysis as a Design Tool in Frac Packing Application to Improve Erosion Life, SPE Annual Technical Conference and Exhibition, Sep. 24-27, 2006, SPE 102209, Society of Petroleum Engineers, San Antonio, Texas, USA.

B. Bloys, et al., Trapped Annular Pressure—A Spacer Fluid That Shrinks, Feb. 20, 2007, pp. 1-10, SPE/IADC 104698, SPE/IADC Drilling Conference, SPE, U.S.A.

Single-Action Bypass Sub brochure, 2007, p. 1, Mi Swaco, U.S.A.

Single-Action Bypass Sub Jetting Tool brochure, 2007, p. 1, Mi Swaco, U.S.A.

B. Bloys, et al., Trapped Annular Pressure Migration: A Spacer Fluid that Shrinks—(Updated), Mar. 4, 2008, pp. 1-15, IADC/SPE 112872, IADC/SPE Drilling Conference, IADC/SPE, U.S.A.

Dennis Denney, Pipe-Rotation Effect on Hole Cleaning for Water-Based Drilling Fluids in Horizontal and Deviated Wells, Journal of Petroleum Technology, Nov. 2008, pp. 65-66, 68; Society of Petroleum Engineers; USA.

* cited by examiner

ANNULAR PRESSURE REGULATING DIAPHRAGM AND METHODS OF USING SAME

BACKGROUND

1. Field of Invention

The invention is directed to pressure relief devices for compensating for pressure changes within sealed or isolated zones of an annulus of an oil or gas wellbore.

2. Description of Art

Sealing or isolating zones or areas of an annulus of wellbores is well known in the art. In general, one or more wellbore barriers such as packers or bridge plugs are disposed with in a wellbore above and below a "zone" or area of the wellbore in which production, or other wellbore intervention operations are performed. In some instances, the isolated zone is not being produced or intervention operations are not being performed, however, tubing, e.g., an inner casing, is disposed through this zone so that oil or gas production or other downhole operations can be performed below the isolated zone. In these instances, the fluid trapped or sealed in this isolated zone can expand or contract depending on the temperature of the fluid trapped in the isolated zone. When the temperature increases, such as during production from other zones within in the wellbore, the fluid expands and can cause damage to the inner casing of the wellbore, the outer casing of the wellbore, other components within the wellbore, or the formation itself. When the temperature decreases, such as when fluid is pumped or injected into the wellbore, the fluid contracts and can cause damage to the inner casing of the wellbore, the outer casing of the wellbore, other components within the wellbore, or the formation itself.

SUMMARY OF INVENTION

In situations where wells are designed with multiple barriers, such as packers, bridge plugs and the like, in the annular space, fluid becomes trapped in the space between these barriers. If the temperature of this trapped fluid increases, such as during production from the well, pressure within this isolated annular space increases. If the temperature of this trapped fluid decreases, such as during injection of fluids into the well, pressure within this isolated annular space decreases. In some situations, these pressure changes can be substantial and may cause failure of critical well components, including damage to the formation itself.

The pressure relief devices disclosed herein facilitate compensation of the pressure within the isolated wellbore annulus. Broadly, the pressure relief devices disclosed herein comprise a tubular member having a housing disposed on an outer wall surface of the tubular member. The housing includes a housing chamber and one or more ports disposed through the housing. An expandable member is disposed within the housing chamber. An interior portion of the expandable member is in fluid communication with the one or more ports. An outer wall surface of the expandable member isolates the remaining volume of the housing chamber to provide a sealed chamber. The sealed chamber can be maintained at atmospheric pressure or at a charged pressure.

The pressure relief devices can be disposed on a tubular string and located within a wellbore. As pressure in an environment located outside the pressure relief device, referred to herein as an "outside environment," such as within an isolated wellbore annulus, increases such as due to an increase in temperature within the outside environment, the resultant increase in pressure is distributed through the port and into the interior of the expandable member causing expansion of the expandable member. As pressure within the outside environment decreases, such as due to a decrease in temperature within that environment, the resultant decrease in pressure is compensated by pressure moving from the interior of the expandable member, through the port, and into the outside environment. As a result, the likelihood that the change in pressure within the outside environment will cause damage to the wellbore or the tubing disposed within the wellbore or any other wellbore component within the outside environment is decreased.

During expansion of the expandable member due to the increased pressure within the outside environment exerting force on the hydrostatic side of the expandable member, the volume of the interior of the expandable member is increased and the volume of the sealed chamber becomes decreased. Decreasing the volume of the sealed chamber energizes the fluid or gas contained in the sealed chamber. Conversely, when the hydrostatic pressure is decreased, the compressed fluid or gas in the sealed chamber exerts a force on the sealed side of the expandable member to force the expandable member back until equilibrium of pressure on both sides of the expandable member is established, or until the expandable member can no longer move, such as due to all of the fluid within the interior of the expandable member being forced out by the pressure of the fluid within the sealed chamber. In other words, the atmospheric pressure or gas pressure within the sealed chamber acts as a return mechanism for the piston.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
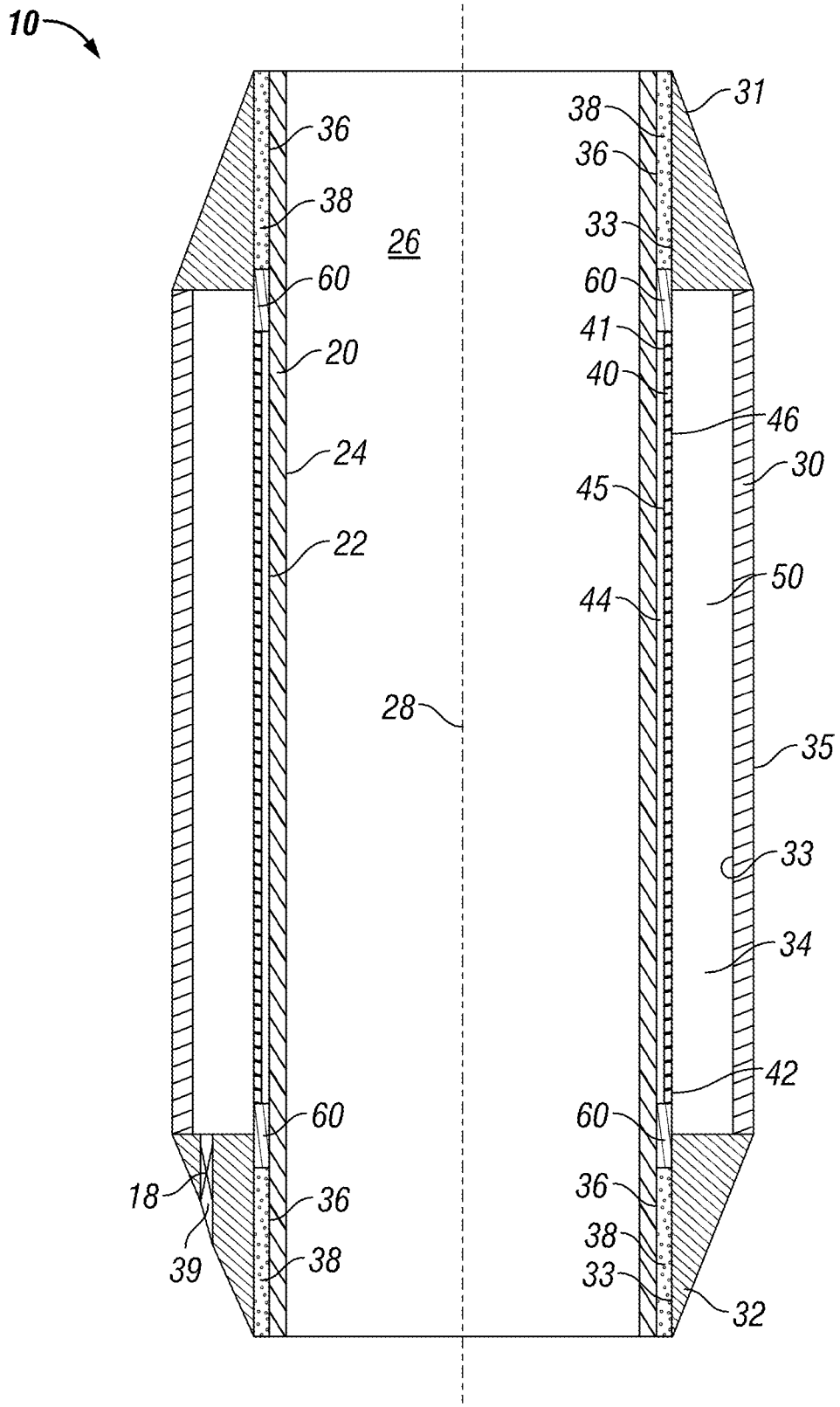
FIG. 1 comprises a cross-sectional view of one specific embodiment of a pressure relief device disclosed herein having an expandable member, FIG. 1 showing the expandable member in a contracted position.
Figure 2:
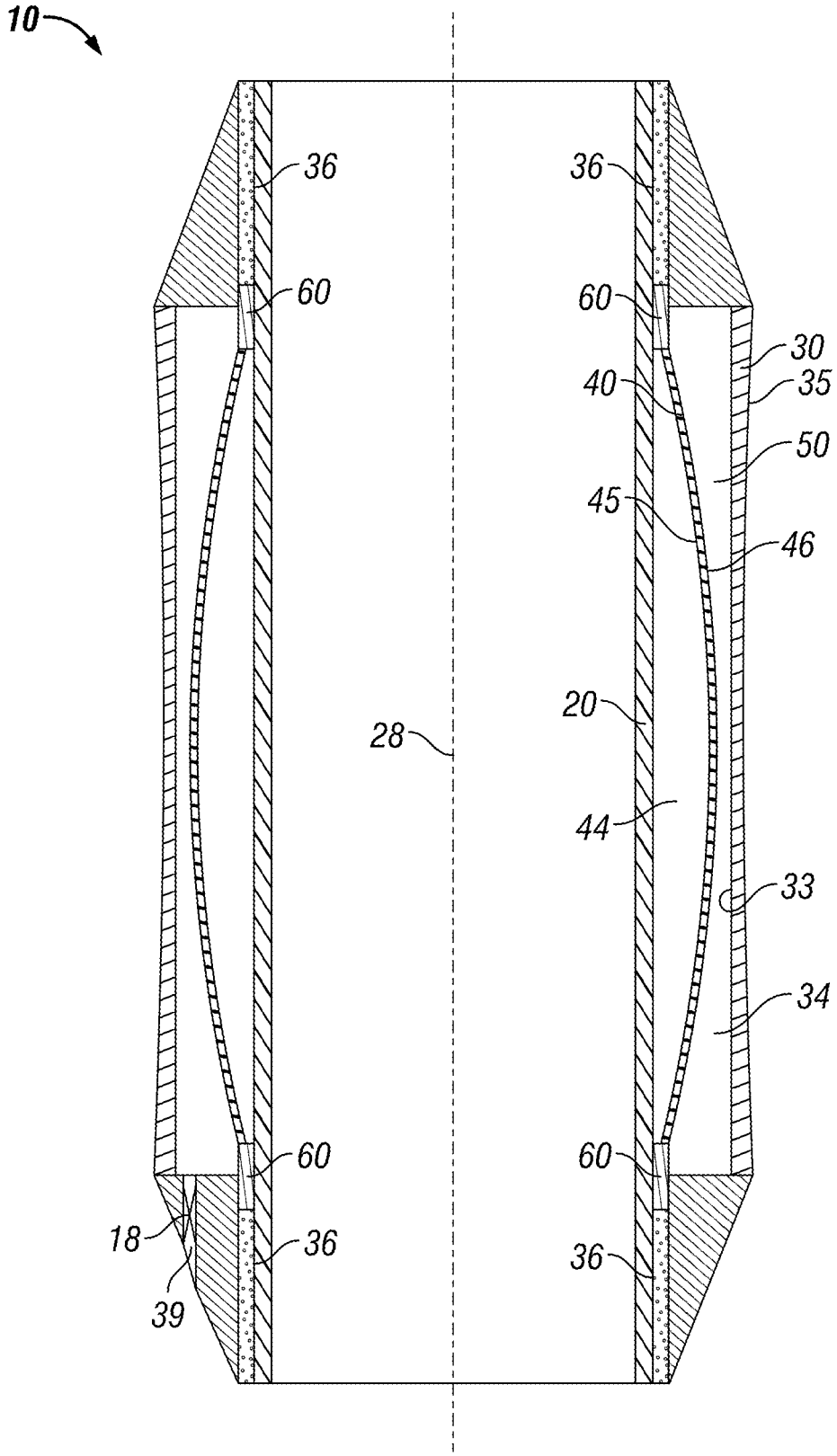
FIG. 2 comprises a cross-sectional view of the pressure relief device of FIG. 1 showing the expandable member in a expanded position.

Referring now to FIGS. 1-2, one specific embodiment of a pressure relief device 10 is shown. This embodiment of pressure relief device 10 comprises tubular member 20 having outer wall surface 22 and inner wall surface 24 defining bore 26 having axis 28. Disposed on outer wall surface 22 is housing 30.

Housing 30 comprises upper end 31 and lower end 32, and inner wall surface 33 for connecting housing 30 to outer wall surface 22 of tubular member 20. Housing 30 also comprises housing chamber 34 and outer wall surface 35. One or more ports 36 are disposed through one or both of upper and lower ends 31, 32. As shown in FIGS. 1-2, housing 30 comprises four ports 36. Ports 36 are in fluid communication with an environment outside of pressure relief device 10 and, as discussed in greater detail below, with an interior of an expandable member.

In the embodiment of FIGS. 1-2, each of ports 36 comprise filter 38 disposed within ports 36 to restrict flow of certain sized particles through ports 36. Filter 38 may be a foam or meshed material formed by a polymer, ceramic, or metal. Alternatively, filter 38 can be glass or sintered metallic beads or other aggregate materials.

Expandable member 40 is disposed within housing chamber 34. Expandable member 40 comprises upper end 41, lower end 42, interior 44 defined by inner wall surface 45, and outer wall surface 46. Interior 44 is in fluid communication with each of ports 36 so that inner wall surface 45 of expandable member 40 which defines interior 44 is referred to herein as the hydrostatic side of expandable member 40. Outer wall surface 46 of expandable member 40 is also referred to herein as the sealed side of expandable member 40 because sealed chamber 50 is defined by outer wall surface 46 of expandable member 40 and upper end 31, lower end 32, and inner wall surface 33 of housing 30. Thus, sealed chamber 50 comprises a portion of housing chamber 34.

Expandable member 40 can be formed out of any material known or desired that permits expansion of expandable member 40. Suitable materials include elastomers such as rubbers, ethylene-propylene terpolymers (EDPM), and the like.

In one particular embodiment, sealed chamber 50 comprises a pressure disposed therein. The pressure within sealed chamber can be atmospheric pressure or can be a charged pressure. A charged pressure means that a fluid such as nitrogen or some other gas or fluid is pumped into sealed chamber 50 to a desired pressure. For example the pressure within sealed chamber 50 can be charged to the operational pressure of pressure relief device 10. Operational pressure is defined herein as the pressure anticipated at the location within the wellbore where pressure relief device 10 will be disposed. As noted above, the charged pressure within sealed chamber 50 can be established using air, nitrogen, or any other gas or fluid desired or necessary to provide the desired pressure within sealed chamber 50. The charged pressure can be established by pumping the gas or other fluid through charge port 39. Charge port 39 can include a one-way check valve 18 or other device known in the art to facilitate injection of the gas or other fluid so that the charged pressure remains within sealed chamber 50.

In the embodiment of FIGS. 1-2, anti-extrusion devices 60 are disposed along outer wall surface 22 of tubular member at upper and lower ends 41, 42 of expandable member 40 so as to prevent expandable member 40 from extruding upward and downward. In embodiments comprising anti-extrusion devices 60, ports 36 pass through anti-extrusion devices 60 so that interior 44 of expandable member 40 is in fluid communication with the environment outside of pressure relief device 10. Anti-extrusion devices 60 can comprise rings or other devices secured to outer wall surface 22 of tubular member 20.

In one specific operation of pressure relief device 10, pressure relief device 10, disposed in the contracted position (shown in FIG. 1), is placed in a work string such as production string or other string of tubing (not shown) and run-into a cased wellbore (not shown). Pressure relief device 10 is then disposed within the cased wellbore at a location where the annulus of the wellbore is isolated from other parts of the wellbore. The isolation of the wellbore can be established by any method or device known in the art such as by use of one or more wellbore barriers such as packers, bridge plugs, valves, wellheads, the bottom of the wellbore, and the like. In so doing, interior 44 of expandable member 40 is placed in fluid communication with the isolated wellbore annulus through ports 36. In the event that the fluid contained within the isolated wellbore annulus expands, or the pressure within the isolated wellbore annulus increases, such as due to production operations being performed through the work string, the increased pressure enters interior 44 of expandable member 40 and exerts a force on inner wall surface 45 causing expansion of expandable member 40 toward the expanded position (shown in FIG. 2). Expansion of expandable member 40 causes the volume of sealed chamber 50 to decrease. As a result, the atmospheric pressure or gas pressure within sealed chamber 50 becomes compressed or "energized." In addition, in certain embodiments, a portion of outer wall surface 35 of housing 30 inflects inwardly as shown in FIG. 2 due to hydrostatic pressure also acting on outer wall surface 35.

Expandable member 40 continues to expand within sealed chamber 50 until the pressure on both inner wall surface 45 and outer wall surface 46 reach equilibrium, or until expandable member 40 can no longer expand due to the size of sealed chamber 50. In so doing, the pressure being exerted on the inner wall of the casing, or the inner wall of the formation, or the outer wall surface of the work string, is spread out and lessened, which decreases the likelihood of failure of any of the casing, the formation, or the work string, or any other wellbore component disposed in the isolated wellbore annulus.

Thereafter, if the pressure within the isolated wellbore annulus decreases, such as due to a temperature decrease due to cessation of production operations through the work string, the compressed atmospheric pressure or compressed fluid pressure within sealed chamber 50 exerts a force against outer wall surface 46 of expandable member 40 that is greater than the hydrostatic pressure within interior 44, i.e., the hydrostatic pressure acting on inner wall surface 45. Accordingly, expandable member 40 contracts from the expanded position (FIG. 2) toward the contracted position (FIG. 1) causing the volume in interior 44 to decrease and the volume of sealed chamber 50 to increase. Expandable member 40 continues to move toward the contracted position, reducing the volume of interior 44 and increasing the volume of sealed chamber 50, until the pressure acting on inner wall surface 45 and outer wall surface 46 reach equilibrium, or until the volume within interior 44 can no longer decrease. Thereafter, expandable member 40 is in a position such that it can again expand in response to a pressure increase within the isolated wellbore annulus.

In another particular embodiment, one or more ports 36 is disposed only through lower end 32. Location of the one or more port 36 through lower end 32 facilitates retaining gas within housing chamber 34 in the event that expandable member 40 fails. For example, in an embodiment in which sealed chamber 50 contains a gas, such as nitrogen, in the event that expandable member 40 fails, the gas will not be allowed to flow out of housing chamber 34. Instead, it would be trapped above any fluid that previously flowed through the one or more ports 36 into interior 44 of expandable member 40. Thus, failure of expandable member 40 will not result in loss of the gas from housing chamber 34.

It is to be understood that the invention is not limited to the exact details of construction, operation, exact materials, or embodiments shown and described, as modifications and equivalents will be apparent to one skilled in the art. For example, the sealed chamber of the pressure relief devices are not required to be charged with a gas or other fluid before use. Instead, sealed chamber may be an atmospheric chamber such that no charging of the sealed chamber required. In addition, the pressure relief devices disclosed herein can be used in circumstances in which the pressure within the wellbore annulus increases or decreases. Moreover, of the use of "upper" and "lower" in describing the embodiments is not intended to limit the direction of the pressure relief devices when in operation. In other words, the pressure relief devices are not required to be disposed in a wellbore where the "upper" structures are toward the top of the wellbore and the "lower" structures are toward the bottom of the wellbore. Accordingly, the use of "upper" and "lower" herein is not intended to limit the orientation of the pressure relief devices within a wellbore. Moreover, a rupture disk or other device can be disposed within the port(s) so that fluid is not permitted to flow through the port(s) until the pressure relief device is located within the well at the desired depth. Accordingly, the invention is therefore to be limited only by the scope of the appended claims.

What is claimed is:

1. A downhole tool comprising:

a tubular member comprising an outer wall surface;

a housing disposed on the tubular member, the housing comprising a housing chamber;

an expandable member disposed in the housing chamber, the expandable member comprising an interior portion, an outer wall surface, a contracted position, and an expanded position the outer wall surface of the expandable member partially defining a sealed chamber within the housing chamber; and at least one port disposed through the housing, the at least one port being in fluid communication with the interior portion of the expandable member and an outside environment, wherein the expandable member moves from the contracted position toward the expanded position due to a pressure increase within an annulus of a wellbore outside of the tubular member, and the expandable member moves from the expanded position toward the contracted position due to a pressure decrease within the annulus of the wellbore outside of the tubular member.

2. The downhole tool of claim 1, wherein the sealed chamber comprises a fluid pressure exerting a force on an outer wall surface of the expandable member.

3. The downhole tool of claim 1, wherein the sealed chamber is charged with a gas at a fluid pressure, the fluid pressure exerting a force on an outer wall surface of the expandable member.

4. The downhole tool of claim 3, wherein the fluid pressure is an operational fluid pressure.

5. The downhole tool of claim 3, wherein the sealed chamber is charged with the gas when the expandable member is in the contracted position.

6. The downhole tool of claim 1, wherein the housing comprises a housing outer wall surface having a portion that inflects inwardly when the expandable member is in the expanded position.

7. The downhole tool of claim 1, wherein the at least one port is disposed through a lower end of the housing.

8. The downhole tool of claim 1, wherein an anti-extrusion device is disposed at an upper end and a lower end of the expandable member.

9. A pressure relief device for compensating for a change in pressure within an isolated outside environment within a wellbore, the pressure relief device comprising:

a tubular member having an outer wall surface and an inner wall surface defining a bore;

a housing disposed on the outer wall surface of the tubular member, the housing having a housing outer wall surface, a housing inner wall surface, a port disposed through the housing outer wall surface, and a housing chamber, the port being in fluid communication with an isolated outside environment outside of the tubular member;

an expandable member disposed within the housing chamber, the expandable member comprising an upper end, a lower end, an outer wall surface, and an inner wall surface, the inner wall surface defining an interior portion of the expandable member, the interior portion being in fluid communication with the port, and the outer wall surface of the expandable member and the housing inner wall surface defining a sealed chamber, wherein the expandable member expands within the housing chamber due to an increase in pressure within the isolated outside environment outside of the tubular member.

10. The pressure relief device of claim 9, wherein the expandable member contracts within the housing chamber due to a decrease in pressure within the isolated outside environment.

11. The pressure relief device of claim 9, wherein the housing comprises a plurality of ports disposed through the housing outer wall surface, each of the plurality of ports being in fluid communication with the interior portion of the expandable member.

12. The pressure relief device of claim 11, wherein a filter is disposed within each of the plurality of ports.

13. The pressure relief device of claim 9, wherein the housing outer wall surface comprises a portion that inflects inwardly when the expandable member expands within the housing chamber due to the increase in pressure within the isolated outside environment.

14. The pressure relief device of claim 9, wherein the sealed chamber is charged with a gas at a fluid pressure, the fluid pressure exerting a force on an outer wall surface of the expandable member.

15. The pressure relief device of claim 14, wherein the gas is nitrogen.

16. The pressure relief device of claim 15, wherein the expandable member is secured to the tubular member at the upper and lower ends of the expandable member and an anti-extrusion device is disposed at the upper and lower ends of the expandable member.

17. A method of reducing pressure within an isolated wellbore annulus, the method comprising the steps of:

(a) disposing a tubular string within a wellbore, the tubular string comprising a tubular member having a housing, the housing having a port and an inner wall surface defining a housing chamber, an expandable member disposed within the housing chamber, the expandable member comprising an interior portion in fluid communication with the port, an outer wall surface of the expandable member and the inner wall surface of the housing defining a sealed chamber, a first wellbore barrier operatively associated with the tubular member, and a second wellbore barrier operatively associated with the tubular member, the second wellbore barrier being disposed below first wellbore barrier, (b) establishing an isolated wellbore annulus with the first and second wellbore barriers, the port being in fluid communication with the isolated wellbore annulus; and (c) expanding the expandable member within the housing chamber due to an increase in pressure within the isolated wellbore annulus causing the sealed chamber to have a reduced volume, thereby reducing pressure within the isolated wellbore annulus.

18. The method of claim 17, further comprising the step of: (d) contracting the expandable member due to a decrease in pressure within the isolated wellbore annulus.

19. The method of claim 18, wherein step (d) is facilitated by a compressed gas contained within the sealed chamber.

20. The method of claim 18, wherein step (d) is facilitated by atmospheric pressure contained within the sealed chamber.

* * * * *